US006516858B1

(12) United States Patent
Anderson et al.

(10) Patent No.: US 6,516,858 B1
(45) Date of Patent: Feb. 11, 2003

(54) HEADRAIL INCLUDING A DETACHABLE BATTERY HOLDER FOR POWERED COVERINGS FOR ARCHITECTURAL OPENINGS

(76) Inventors: Richard N. Anderson, 9885 Melba La., Whitesville, KY (US) 42378; Donald E. Fraser, 251A Pompano Dr. SE., St. Petersburg, FL (US) 33705; Everett S. Coleman, 6576 Hwy. 144, Owensboro, KY (US) 42303

( * ) Notice: Subject to any disclaimer, the term of this patent is extended or adjusted under 35 U.S.C. 154(b) by 0 days.

(21) Appl. No.: 09/481,237

(22) Filed: Jan. 11, 2000

Related U.S. Application Data

(60) Provisional application No. 60/138,743, filed on Jun. 11, 1999, provisional application No. 60/126,104, filed on Mar. 25, 1999, and provisional application No. 60/115,393, filed on Jan. 11, 1999.

(51) Int. Cl.[7] ..... E06B 9/30

(52) U.S. Cl. ..... 160/168.1 P; 160/176.1 P; 160/188; 429/99; 429/100

(58) Field of Search ..... 160/168.1 P, 176.1 P, 160/84.02, 188, 310; 429/99, 100

(56) References Cited

U.S. PATENT DOCUMENTS

| | | | | |
|---|---|---|---|---|
| 4,514,477 | A | * | 4/1985 | Kobayashi |
| 4,532,194 | A | * | 7/1985 | Liautaud et al. |
| 4,623,012 | A | | 11/1986 | Rude et al. |
| 5,228,491 | A | | 7/1993 | Rude et al. |
| 5,415,955 | A | * | 5/1995 | Kobayashi et al. |
| 5,495,153 | A | | 2/1996 | Domel et al. |
| 5,662,154 | A | | 9/1997 | Drake, III |
| 5,935,729 | A | * | 8/1999 | Mareno et al. |
| 6,371,192 | B1 | * | 4/2002 | Anderson et al. |
| 6,382,294 | B1 | * | 5/2002 | Anderson et al. |

FOREIGN PATENT DOCUMENTS

| | | |
|---|---|---|
| AU | 76262/91 | 11/1991 |
| CA | 2162443 | 5/1996 |
| DE | 8229134 | 1/1983 |
| DE | 29508479 | 9/1995 |
| GB | 2076454 | 9/1983 |
| NZ | 161962 | 2/1972 |

* cited by examiner

*Primary Examiner*—Blair M. Johnson

(57) ABSTRACT

A headrail including a detachable battery holder for powered coverings for architectural openings is disclosed. The headrail comprises a housing defining an interior into which a battery magazine is removably mounted. In this manner, the batteries are hidden within the headrail for a more aesthetically pleasing look than can be achieved when the batteries are mounted outside of the headrail. The housing may include one or more small slots into which corresponding tabs on end caps mounted on the ends of the battery magazine may be inserted. The housing may also include a larger opening through which batteries may be inserted into or extracted from the battery magazine while it is mounted in the housing. Further, the housing may include one or more elongated openings for cooling, or through which installed batteries may be inspected, or into which tools may be inserted to move the batteries that are installed in the battery magazine.

28 Claims, 9 Drawing Sheets

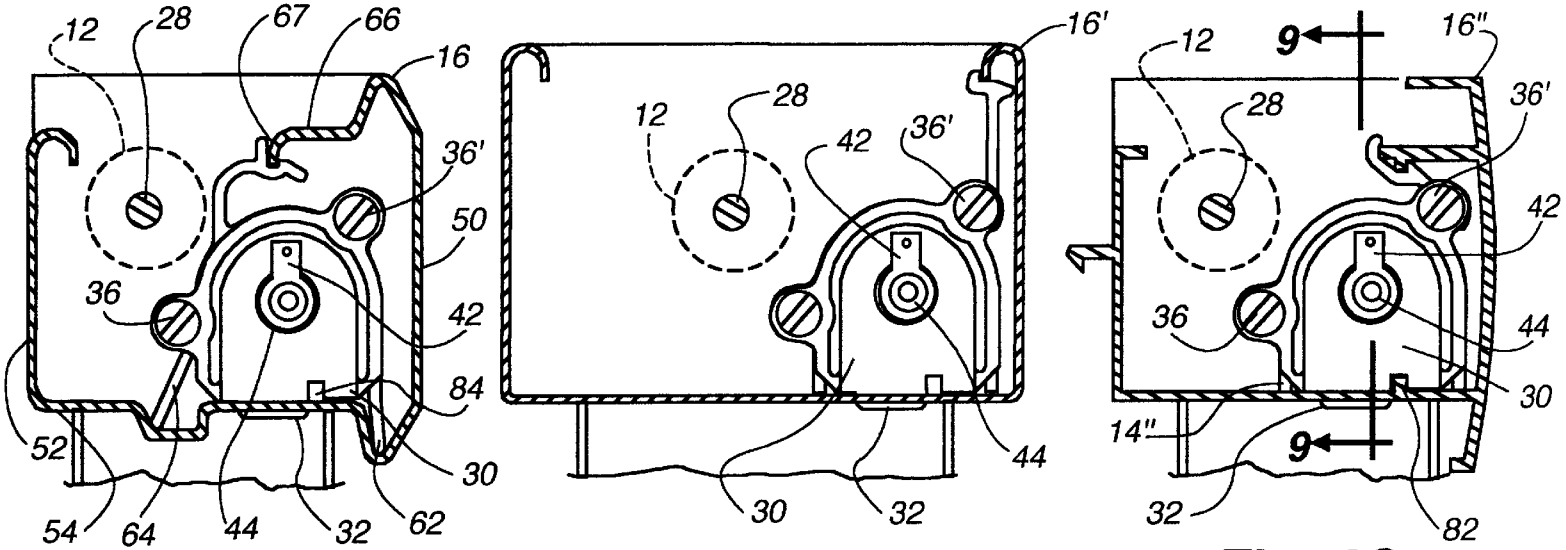
Fig. 4C
Fig. 4B
Fig. 4A
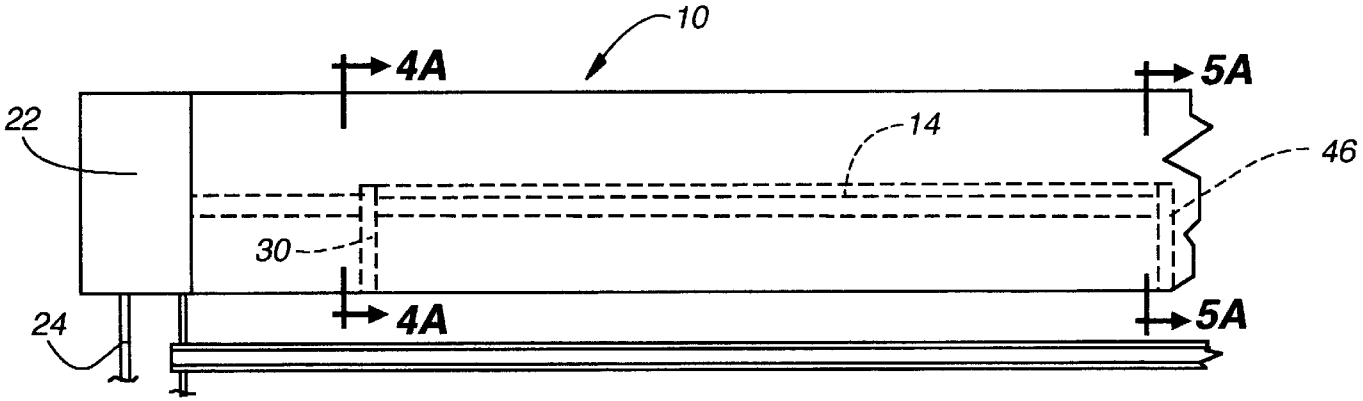
Fig. 3

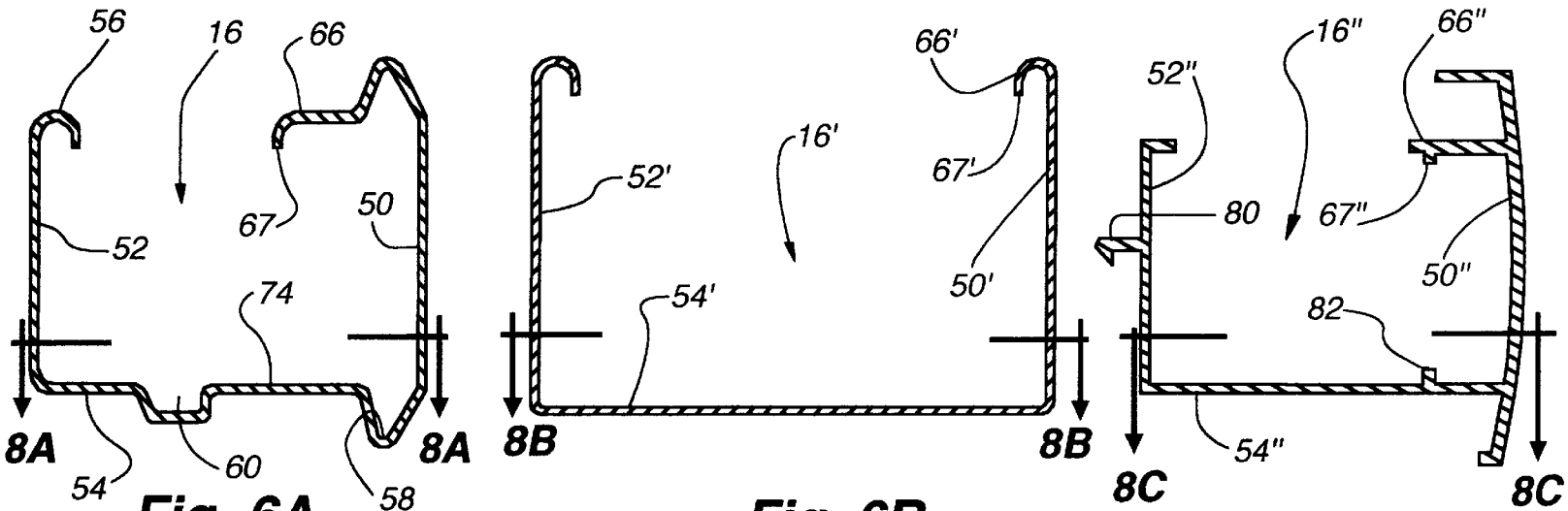
Fig. 6C
Fig. 6B
Fig. 6A
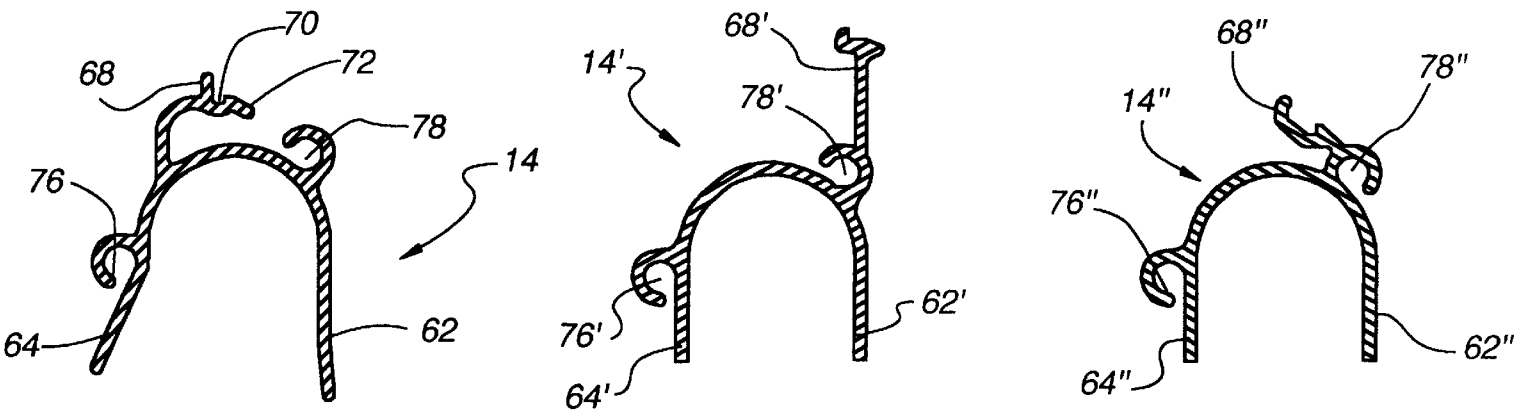
Fig. 7C
Fig. 7B
Fig. 7A

34'
86
86
16
54
55
34
60
58
74

16'
54'
34'
86
55'
34

34'
86
16''
54''
55''
34
82

HEADRAIL INCLUDING A DETACHABLE BATTERY HOLDER FOR POWERED COVERINGS FOR ARCHITECTURAL OPENINGS

CROSS-REFERENCE TO RELATED APPLICATIONS

This application is related and claims priority to U.S. provisional application Ser. No. 60/138,743, filed Jun. 11, 1999, and entitled "Headrail Including a Detachable Battery Holder for Powered Coverings for Architectural Openings." It is also related and claims priority to U.S. provisional application Ser. No. 60/115,393, filed Jan. 11, 1999, and entitled "Window Blind with Motorized Tilt Control"; and U.S. provisional Ser. No. 60/126,104, filed Mar. 25, 1999, and entitled "Motorized Blind." The present application is also related to U.S. utility application Ser. No. 09/480,913, filed Jan. 11, 2000, entitled "Headrail Including a Trap Door for Accessing Batteries for Powered Coverings for Architectural Openings"; U.S. utility application Ser. No. 09/480, 913, filed Jan. 11, 2000, entitled "System for Holding Batteries in a Headrail for Powered Coverings for Architectural Openings"; 09/481,746, filed Jan. 11, 2000, entitled "Fiber Optic Cable, Signal-Receiving System"; and 09/481, 307, filed Jan. 11, 2000, entitled "Headrail and Control System for Powered Coverings for Architectural Openings," all of which are being filed concurrently herewith. Each of these related applications (namely, the '743, '393, '104, '913, '912, '746, and '307 applications) is hereby incorporated by reference as though fully set forth herein.

BACKGROUND OF THE INVENTION a. Field of the Invention

The instant invention is directed toward a headrail for a powered covering for an architectural opening. More specifically, it relates to a headrail for a battery-powered adjustable covering for an architectural opening.

b. Background Art

It is well known to use adjustable coverings over architectural openings. Such adjustable coverings include cellular panels, Venetian blinds, and many other mechanisms for controlling the passage of light, vision, or air through the architectural openings. For example, cellular panels and Venetian blinds may be adjusted by retracting or extending them, and Venetian blinds may be adjusted by tilting the slats. Depending upon the specific type of mechanism, other adjustments are possible.

It is also known in the art to power these adjustable coverings. For example, electric motors may be used in connection with the adjustable coverings to facilitate retracting the covering or otherwise adjusting the covering to control the amount of light or air that may pass through the covering. It is also known in the art to use battery-powered electric motors, particularly in applications where access to an electrical outlet or other electrical wiring may not exist. In applications where access to the covering may be limited, it is also know to use remote controls to operate the electric motors that configure the covering. For example, when adjustable coverings are used in connection with elevated architectural openings, it may be quite inconvenient to manually change the configuration of the covering.

When an adjustable covering is battery-powered, it is challenging to design an aesthetically pleasing system wherein the battery or batteries are convenient to the electric actuators they power. To design an attractive battery-powered adjustable covering, it is preferable that the battery or batteries are located within the headrail and thereby hidden from view.

SUMMARY OF THE INVENTION

The headrail of the present invention has been designed such that a battery or batteries are conveniently hidden within the headrail. The headrail comprises a housing having an interior and a battery magazine removably attached within the interior of the housing. In one form of the invention, a pair of magazine end caps are attached to the ends of the battery magazine. These end caps may have tabs extending from their bottom edges. The tabs are inserted into corresponding tab slots formed in the housing. Further, each magazine end cap may comprise a first attachment ear and a second attachment ear. Attachment screws pass through though these attachment ears and screw into battery magazine screw channels to attach the end caps to the battery magazine.

In another form of the invention, the battery magazine comprises a front leg and a rear leg. These front and rear legs of the battery magazine are supported on a bottom wall of the housing. In yet another form of the invention, the housing comprises a front wall, a rear wall, and a portion extending into the interior of the housing from either the front wall or the rear wall. This extending portion interacts with a placement tang that comprises part of the battery magazine thereby helping to hold the battery magazine in position within the housing.

In yet another form of the invention, the housing further comprises a bottom wall having an opening in it through which one or more batteries may be loaded into or extracted from the battery magazine.

To conduct electricity from the batteries held by the battery magazine to a battery-powered actuator, the headrail further comprises conductive terminals attached to the magazine end caps by fasteners. A spring may be attached within the battery magazine to enhance electrical contact between the batteries and the conductive terminals. Finally, an electrical connector is connected between the conductive terminals and the actuator.

A more detailed explanation of the invention is provided in the following description and claims, and is illustrated in the accompanying drawings.

BRIEF DESCRIPTION OF THE DRAWINGS

FIG. 3 is a fragmentary front view along line 3—3 of FIG. 2, depicting various features of the battery holder in phantom;

FIG. 4A is a cross-sectional view along line 4A—4A of FIG. 3, depicting a first preferred embodiment of the headrail according to the present invention, adjacent a first battery magazine end cap;

FIG. 4B is a cross-sectional view similar to FIG. 4A, but depicting a second preferred embodiment of the headrail according to the present invention;

FIG. 4C is a cross-sectional view similar to FIG. 4A, but depicting a third preferred embodiment of the headrail according to the present invention;

FIG. 6A is a cross-sectional view of the first preferred embodiment of the housing, which is also depicted in FIGS. 4A, 5A, and 8A;

FIG. 6B is a cross-sectional view of the second preferred embodiment of the housing, which is also depicted in FIGS. 4B, 5B, and 8B;

FIG. 6C is a cross-sectional view of the third preferred embodiment of the housing, which is also depicted in FIGS. 4C, 5C, and 8C;

FIG. 7A is a cross-sectional view of the first preferred embodiment of the battery magazine, which is also depicted in FIGS. 4A, 5A, and 11;

FIG. 7B is a cross-sectional view of the second preferred embodiment of the battery magazine, which is also depicted in FIGS. 4B, 5B, 13, and 14;

FIG. 7C is a cross-sectional view of the third preferred embodiment of the battery magazine, which is also depicted in FIGS. 4C, 5C, 10, 15, and 16;

DESCRIPTION OF THE PREFERRED EMBODIMENTS

Several embodiments of a headrail for a battery-powered adjustable covering for an architectural opening are disclosed. An advantage of the instant invention over the prior art is that a battery magazine removably snaps into a housing for the headrail to hold one or more batteries in position within the headrail. Depending upon the configuration of the housing desired for a particular application, an appropriate magazine is used. Once the appropriate magazine is removably snapped into the corresponding housing in position, additional, interchangeable components described below are added to facilitate transfer of electrical energy from the batteries to one or more electrical devices for adjusting the configuration of the covering. Clearly, the batteries and other components could be combined with the magazine before it is snapped into the housing.

Figure 1:
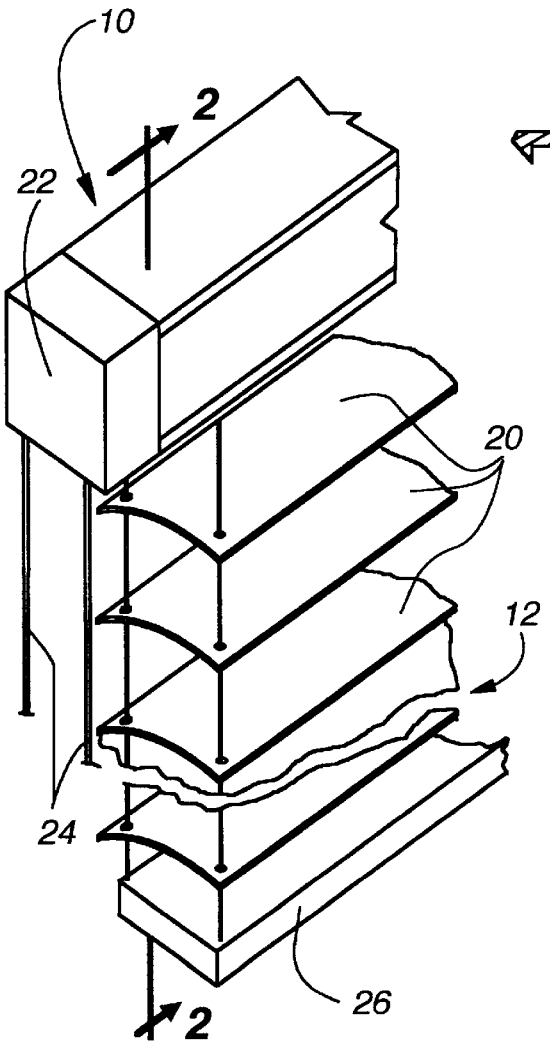
FIG. 1 is a fragmentary isometric view showing the front, top, and left end of a headrail, adjustable covering, and bottom rail for an architectural opening.

Referring first to FIG. 1, a fragmentary isometric view of the front, top, and left end of a headrail 10 and an adjustable covering 12 for an architectural opening is shown. Although the adjustable covering 12 depicted in FIG. 1 is a Venetian blind comprising a plurality of slats 20, for purposes of the instant invention, the particular type of covering 12 used is unimportant. FIG. 1, therefore, provides a context for describing the present invention. In the Venetian blind covering 12, a battery-powered motor within the headrail 10 may be used, for example, to regulate the passage of air or light through the substantially horizontal slats 20 of the covering 12 by tilting or rotating the slats 20 about their longitudinal axes a desired amount. As depicted in FIG. 1, the headrail 10 has a left end cap 22 attached thereto. Also shown in FIG. 1 are cords 24 for manually operating the adjustable covering 12, and a bottom rail 26 attached at the bottom of the covering 12.

Figure 2:
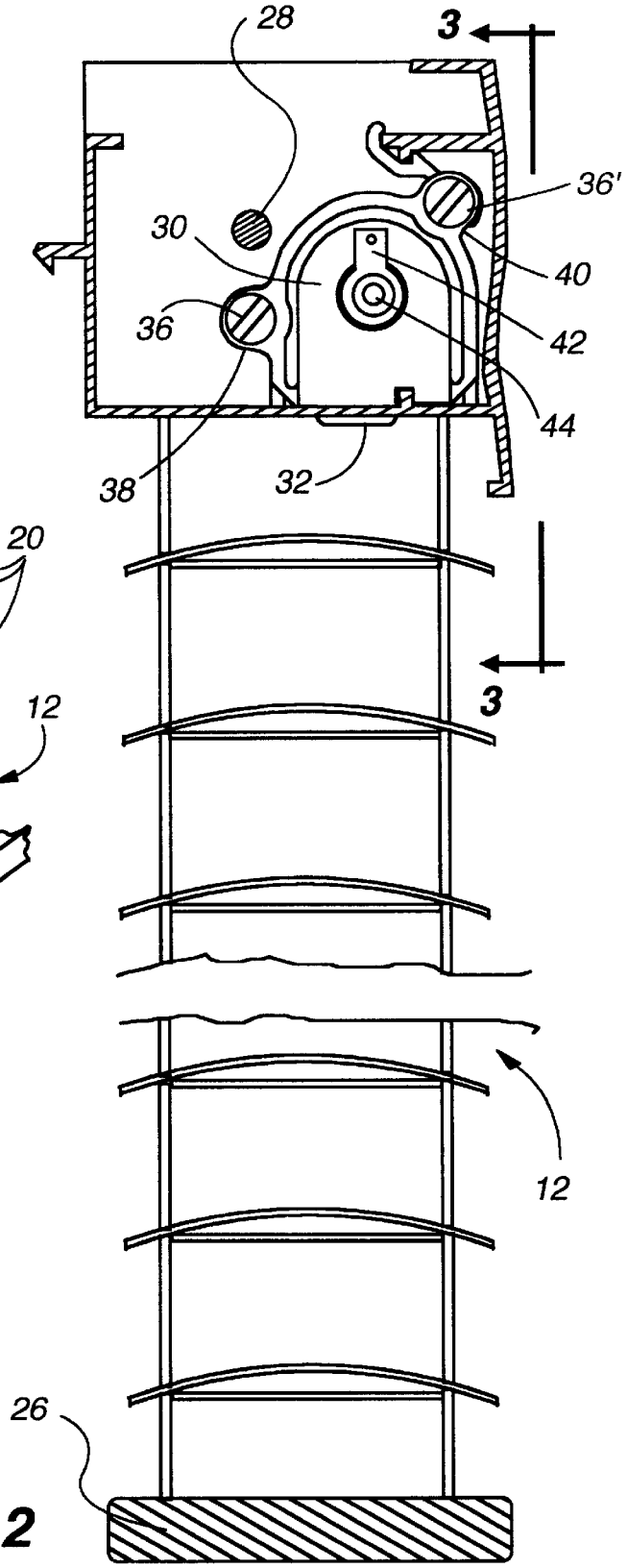
FIG. 2 is a fragmentary cross-sectional view along line 2—2 of FIG. 1, depicting the headrail including a battery holder according to the present invention.

FIG. 2 is a fragmentary cross-sectional view along line 2—2 of FIG. 1. A tilt rod 28, which would be used to adjust the configuration of the covering 12, is shown schematically in FIG. 2. FIG. 2 is the view looking inside of the headrail 10 with the left headrail end cap 22 removed. With the left end cap 22 thus removed, it is possible to see a first magazine end cap 30, which, as described more fully below, has a tab 32. This tab 32 snaps into a first tab slot 34 (see, e.g., FIGS. 8A, 8B, and 8C, which clearly show the first tab slot 34) to position and hold the battery magazine 14 (depicted to good advantage in, for example, FIG. 11) within the headrail 10. Also depicted in FIG. 2 are two screws 36, 36', which attach the first magazine end cap 30 to the magazine 14 via a first attachment ear 38 and a second attachment ear 40. In the preferred embodiment, both of these attachment ears 38, 40 are integrally formed as part of the first magazine end cap 30. Also depicted in FIG. 2 is an electrical terminal 42, which is connected to the first magazine end cap 30 by a fastener 44. Further details concerning these features are described further below.

FIG. 3 is a fragmentary front view of the adjustable covering 12, showing the left headrail end cap 22, a single slat 20, and the portion of the headrail 10 behind which is the magazine 14. The magazine 14, the first magazine end cap 30, and a second magazine end cap 46 are shown in FIG. 3 in phantom. The first and second magazine end caps 30, 46 are interchangeable. Since the length of the headrail 10 depends upon the size of the architectural opening to be covered, the portion of the headrail 10 to the right of the battery magazine 14 is broken away in FIG. 3. Similar to FIG. 1, FIG. 3 thus provides context for understanding how the snap-in battery holder of the present invention is used in conjunction with the adjustable window covering 12.

FIG. 4A is a cross-sectional view along line 4A—4A of FIG. 3 and depicts a magazine 14 and housing 16 according to a first preferred embodiment of the present invention. This view is taken just outside of the first magazine end cap 30 as clearly shown in FIG. 3. The tilt rod 28, having a portion of the covering 12 rolled thereon, is depicted in FIG. 4A for context. FIG. 4A shows the first magazine end cap 30 secured by a pair of screws 36, 36' to the left end of the magazine 14. Also visible in FIG. 4A is the terminal 42 affixed to the first magazine end cap 30 by the fastener 44. Details of the housing 16 and the magazine 14 of the first preferred embodiment according to the present invention are described next with reference to FIGS. 5A, 6A, and 7A.

Figures 5A, 5B, 5C:
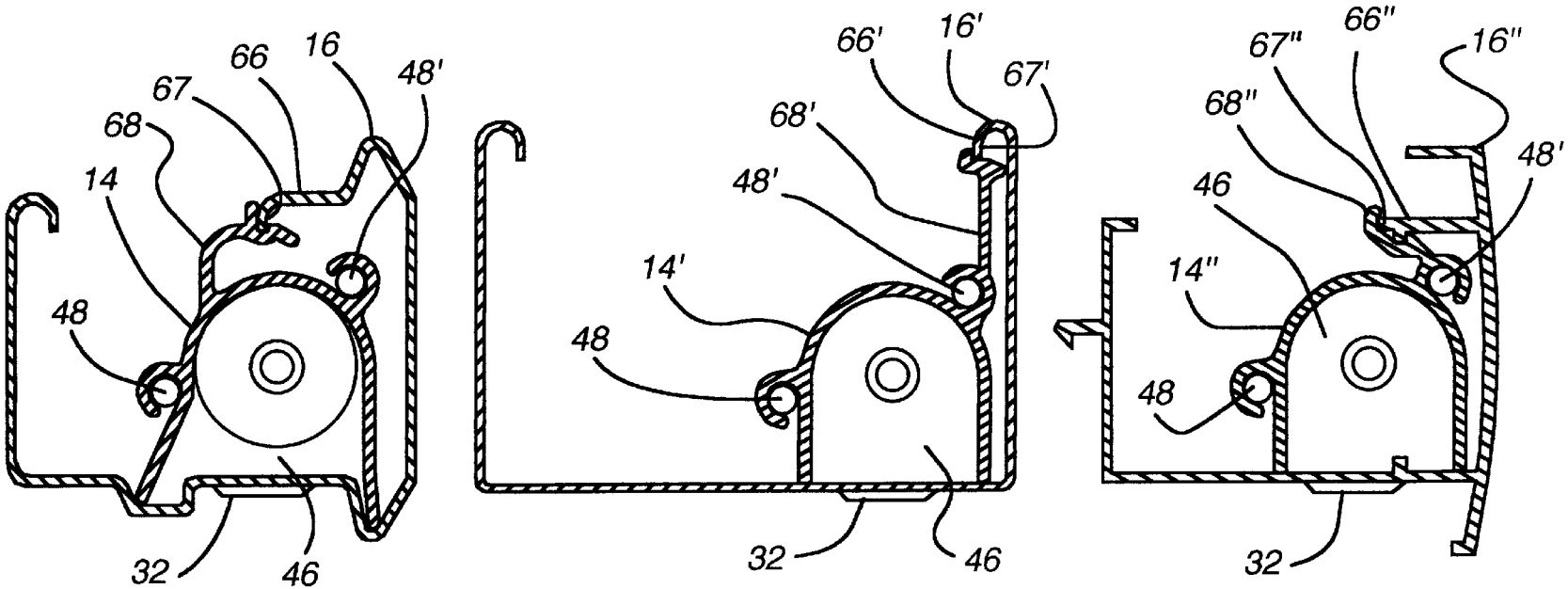
FIG. 5A is a cross-sectional view along line 5A—5A of FIG. 3, depicting the first preferred embodiment of the headrail according to the present invention, adjacent a second battery magazine end cap.
FIG. 5B is a cross-sectional view similar to FIG. 5A, but depicting the second preferred embodiment of the headrail according to the present invention.
FIG. 5C is a cross-sectional view similar to FIG. 5A, but depicting the third preferred embodiment of the headrail according to the present invention.

FIG. 5A is a cross-sectional view of the housing 16 and magazine 14 along line 5A—5A of FIG. 3. This view is taken just inside of the second magazine end cap 46 as clearly shown in FIG. 3. Thus, the inner surface of the second magazine end cap 46 may be clearly seen in FIG. 5A. Also, the ends of the attachment screws 48, 48' (these are interchangeable with the screws 36, 36' securing the first magazine end cap 30 to the magazine 14), opposite from the slotted ends that are used to secure the screws, are visible in FIG. 5A.

FIGS. 6A and 7A depict cross-sectional views of the housing 16 and magazine 14, respectively. Referring first to FIG. 6A, the housing 16 of the first preferred embodiment according to the present invention is described next. The housing 16 comprises a front wall 50, a rear wall 52, and a bottom wall 54. The top edge 56 of the rear wall 52 is curved. The front wall 50 of the housing 16 and possibly the bottom wall 54 of the housing 16 are visible when the adjustable covering 12 is installed and operational. Thus, the front wall 50 of the housing 16 may have a decorative shape. Similarly, since the bottom wall 54 may be visible, it too may have a decorative shape. In this first preferred embodiment of the present invention, the bottom wall 54 also comprises a first channel 58 and a second channel 60. The first channel 58 receives a front leg 62 (FIG. 7A) of the magazine 14, and the second channel 60 receives a rear leg 64 (FIG. 7A) of the magazine 14, once the magazine 14 is snapped into position in the housing 16. The housing 16 also comprises a portion 66 that extends rearwardly from the front wall 50 of the housing 16. A free end 67 of this portion 66 of the housing 16 interacts with a placement tang 68 (seen to good advantage in, for example, FIGS. 4A, 5A, and 7A) comprising part of the magazine 14.

Figures 8A, 8B, 8C:
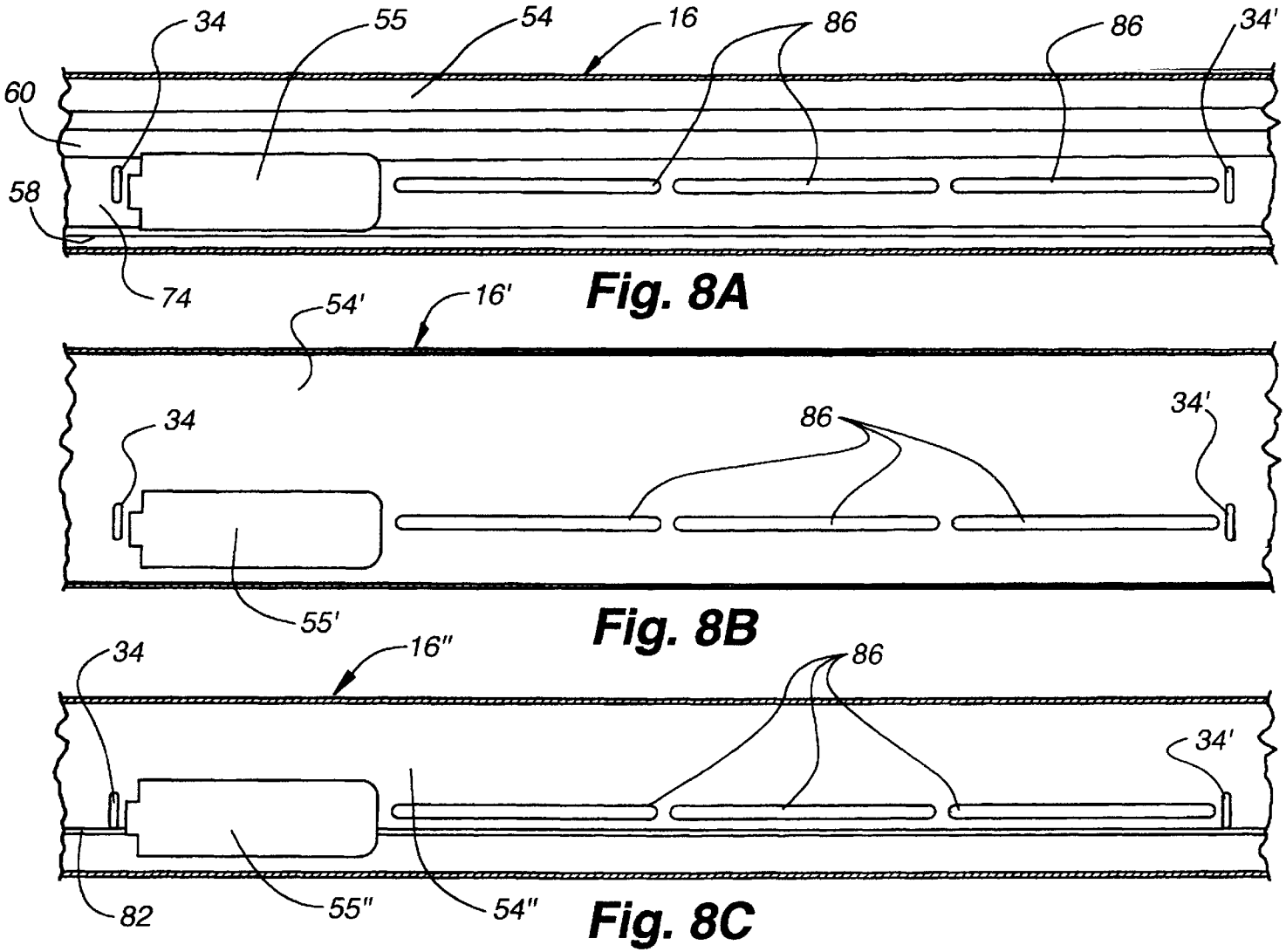
FIG. 8A is a fragmentary cross-sectional top view along line 8A—8A of FIG. 6A, depicting the inside of the housing according to the first preferred embodiment in the region below the batteries.
FIG. 8B is a fragmentary cross-sectional top view along line 8B—8B of FIG. 6B, depicting the inside of the housing according to the second preferred embodiment in the region below the batteries.
FIG. 8C is a fragmentary cross-sectional top view along line 8C—8C of FIG. 6C, depicting the inside of the housing according to the third preferred embodiment in the region below the batteries.

In the first preferred embodiment, the portion 66 of the housing 16 extending rearwardly from the front wall 50 engages a channel 70 in the distal end of the placement tang 68 on the magazine 14. For example, to snap the magazine 14 into the housing 16, one could place the front leg 62 of the magazine 14 into the first channel 58 of the housing 16 and then push the rear leg 64 of the magazine 14 into the second channel 60 of the housing 16. As the magazine 14 thus snaps into position in the housing 16, the extended portion 66 of the housing 16 would be guided up a sloped surface 72 at the extreme distal end of the placement tang 68 and into the channel 70. FIG. 8A is a cross-sectional view along line 8A—8A of FIG. 6A, and depicts the tab slots 34, 34', which accommodate the tabs 32 comprising part of the magazine end caps 30, 46, a battery-shaped opening 55 in a ledge 74 between the first channel 58 and the second channel 60, and three elongated openings 86. The battery-shaped opening 55 and the three elongated openings 86 are discussed further below.

Referring now to FIG. 7A, further details of the magazine 14 are next described. FIG. 7A is a cross-sectional view of the magazine 14 according to the first embodiment of the present invention. As mentioned above, the magazine 14 comprises a front leg 62 and a rear leg 64. A screw channel 76 is integrally formed as part of the rear leg 64 of the magazine 14. The screw channel 76 may be clearly seen in FIG. 11. A similar screw channel 78 is integrally formed in the magazine 14 at an upper portion of the front leg 62. Again, this screw channel 78 is visible in, for example, FIG. 11. These screw channels 76, 78 are molded so that their inside diameter is slightly smaller than the outside diameter of the screws 36, 36', 48, 48' which hold the magazine end caps 30, 46 in position. Thus, when the screws 36, 36', 48, 48' are inserted through the magazine end caps 30, 46 and threaded into the screw channels 76, 78, the threads on the screws are able to bind in the interior surface of the screw channels and thus hold the magazine end caps 30, 46 in position.

Referring now to FIGS. 4B, 5B, 6B, 7B, and 8B, the housing 16'and magazine 14'of a second preferred embodiment according to the present invention, are described next. FIG. 4B is a cross-sectional view similar to FIG. 4A, which was taken along line 4A—4A of FIG. 3, but taken of the housing 16'and magazine 14'according to the second preferred embodiment. Referring to FIG. 4B, it again shows a tilt rod 28 with a portion of the covering 12 wound thereon. The tilt rod 28 and covering 12 are shown in FIG. 4B schematically for context purposes. Clearly visible in FIG. 4B is the first magazine end cap 30 in position on the left end of the magazine 14'. The first magazine end cap 30 is held in position by a pair of screws 36, 36'. Also visible in FIG. 4B is a terminal 42, which has been fixed to the first magazine end cap 30 by a fastener 44.

Referring now to FIG. 5B, which is similar to FIG. 5A, the interconnections of the magazine 14' to the housing 16' for the second preferred embodiment of the present invention is clearly shown. FIG. 5B is taken from the same perspective that FIG. 5A was taken from (i.e., along line 5A—5A of FIG. 3). Visible in FIG. 5B is the second magazine end cap 46, which is secured to the right end of the magazine 14'. This second magazine end cap 46 is secured to the magazine according to the second preferred embodiment in the same manner that the second magazine end cap 46 was secured to the right hand end of the magazine 14 in FIG. 5A. Namely, a pair of screws 48, 48' pass through attachment ears 38, 40 (see, e.g., FIG. 11) of the magazine end cap 30 and are screwed into the screw channels 76, 78 integrally formed as part of the magazine 14'.

Referring to FIG. 6B, the housing 16' according to a second preferred embodiment of the present invention is described next. This embodiment of the housing 16' is more symmetrical than the embodiment depicted in FIG. 6A. In the housing 16' as depicted in FIG. 6B, the front wall 50'is substantially a mere image of the rear wall 52'. Further, the bottom wall 54' in this preferred embodiment is substantially flat and does not contain channels similar to those comprising a portion of the housing 16 depicted in FIG. 6A. This substantially flat bottom wall 54' may be clearly visible in FIG. 8B, which is a cross-sectional view along line 8B—8B of FIG. 6B. In particular, FIG. 8B shows a view from the inside of the housing 16' of the bottom wall 54' of the housing 16', and depicts the tab slots 34, 34', which accommodate the tabs 32 comprising part of the magazine end caps 30, 46, a battery-shaped opening 55', and three elongated openings 86. The battery-shaped opening 55' and the elongated openings 86 are discussed further below.

Referring next to FIG. 7B, the magazine 14' according to the second preferred embodiment of the present invention is shown in cross-section. In this embodiment, the placement tang 68' extends substantially vertically upward from the outer surface of the screw channel 78' positioned near the top of the front leg 62'. As shown in FIG. 5B, when the magazine 14' is in position within the housing 16', a free end 67' of an extended portion 66' of the front wall 50' of the housing 16' engages the placement tang 68', forming part of the magazine 14'. When the magazine 14' is in position, with the magazine end caps 30, 46 in position and the tabs 32 extending from the bottom edges of the end caps 30, 46 locked in the tab slots 34, 34' in the housing (the tab slots 34, 34' may be clearly seen in FIGS. 8A, 8B, and 8C), the portion 66' extending from the front wall 50' of the housing 16' helps hold the magazine 14' in position by exerting pressure on the placement tang 68' similar to what was done in the first preferred embodiment of the present invention.

Referring next to FIGS. 4C, 5C, 6C, 7C, and 8C, the housing 16" and magazine 14", according to a third preferred embodiment of the present invention are described next. FIG. 4C is similar to FIG. 4A, but depicts the housing 16" and magazine 14" according to the third preferred embodiment, whereas FIG. 4A depicts the housing 16 and magazine 14 according to the first preferred embodiment. Again, the tilt rod 28 and the covering 12 are shown schematically in FIG. 4C for context. Also clearly visible in FIG. 4C, is the first magazine end cap 30 with its tab 32 in position in the tab slot 34 (see FIG. 8C to view this tab slot 34) of the housing 16". The first magazine end cap 30 is held in position by a pair of screws 36, 36' which are clearly visible in FIG. 4C. The terminal 42 attached to the first magazine end cap 30 by the fastener 44 is also shown in FIG. 4C.

FIG. 5C is similar to FIG. 5A, but depicts a cross-sectional view along line 5A—5A of the magazine 14" and housing 16" according to the third preferred embodiment of the present invention. As was the case in FIGS. 5A and 5B, the second magazine end cap 46 with its tab 32 in position in the appropriate tab slot 34' (FIG. 8C), is clearly visible in FIG. 5C. Also clearly visible in FIG. 5C are the ends of the screws 48, 48' which hold the second magazine end cap 46 in position on the magazine 14".

FIGS. 6C and 7C are cross-sectional views of the housing 16" and magazine 14", respectively, of the third and preferred embodiment of the instant invention. As shown to the best advantage in FIG. 6C, the front wall 50" of the housing 16" in the third preferred embodiment is arcuate. The rear wall 52" of the housing 16" according to the third preferred embodiment has a projection 80 extending therefrom. The bottom wall 54" of the housing 16" according to the third preferred embodiment has a longitudinally extending rib 82 integrally formed as part thereof. This rib 82 may be clearly seen, for example, in FIG. 8C, which is a partial cross-sectional view taken along line 8C—8C of FIG. 6C. In FIG. 8C, the rib 82 is shown as extending from left to right across the figure. Also clearly visible in FIG. 8C are the tab slots 34, 34', a battery-shaped opening 55", and three elongated openings 86. The battery-shaped opening 55" and the elongated openings 86 are discussed further below.

Figure 13:
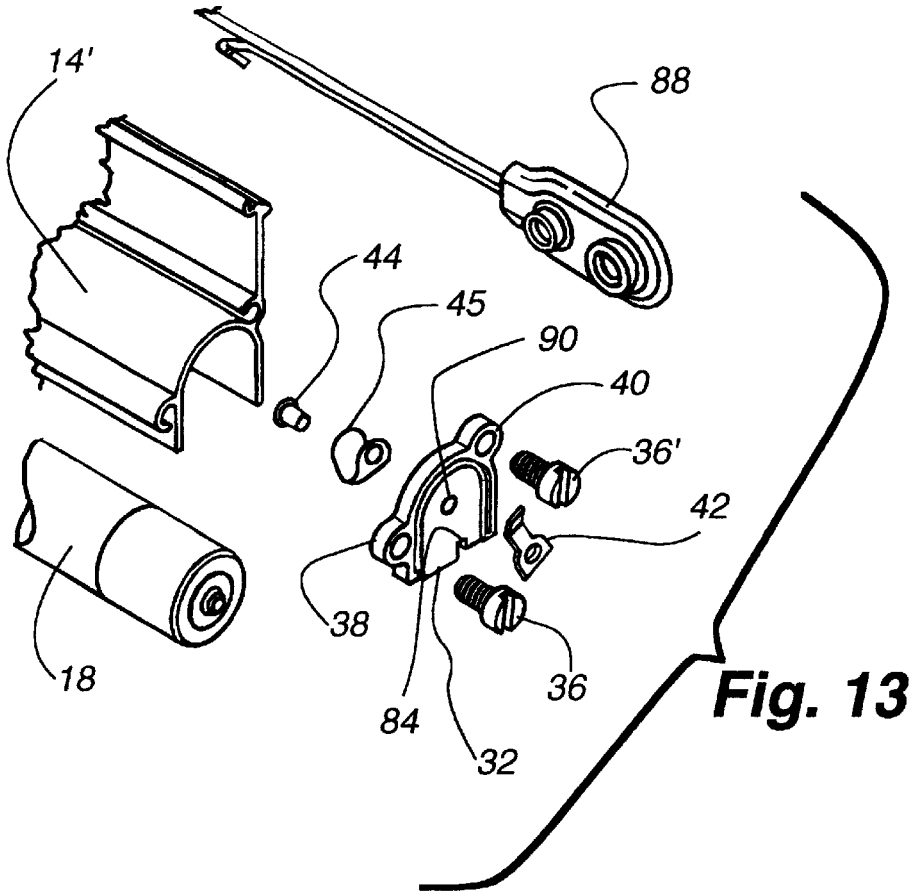
FIG. 13 is an exploded fragmentary isometric view similar to the right-hand end of FIG. 11, but depicting the battery magazine of the second preferred embodiment.
Figure 14:
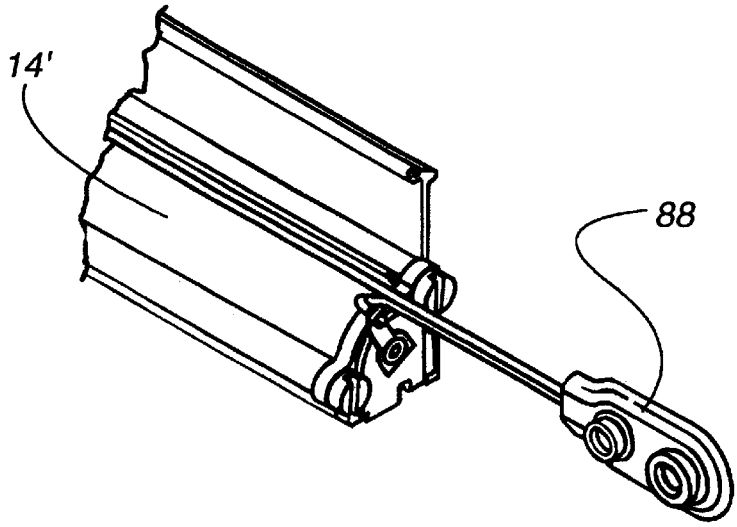
FIG. 14 is a fragmentary isometric view similar to FIG. 13, but the parts shown as exploded in FIG. 13 are fully assembled in FIG. 14.

As most clearly shown in FIGS. 4C, 13, and 14, the magazine end caps 30, 46 include a notch 84. When the housing 16" is formed according to the third preferred embodiment of the instant invention, the notch 84 in the magazine end caps 30, 46 rides on the rib 82 comprising part of the housing 16". Thus, when the magazine end caps 30, 46 are in position, and the magazine 14" is in position within the housing 16", the tabs 32 on the magazine end caps 30, 46 lock into the tab slots 34, 34' in the bottom wall 54" of the housing 16", and the rib 82 comprising part of the bottom wall 54" of the housing 16" is retained by the notch 84 in the magazine end caps 30, 46. The tabs 32 interacting with the tab slots 34, 34' and the rib 82 interacting with the notches 84 on the magazine end caps 30, 46 both help to hold the magazine 14" in position within the housing 16".

As shown in FIG. 7C, a placement tang 68" comprises a portion of the magazine. This placement tang 68" is an integrally formed portion of the magazine 14" and extends from the material forming the upper screw channel 78". As was the case in the first and second preferred embodiments, when the magazine 14" is in position within the housing 16", a free end 67" of a portion 66" of the housing 16" (FIG. 6C) engages the placement tang 68" as shown to the best advantage in FIG. 5C. This interaction between the placement tang 68" and the portion 66" of the housing 16" extending from the front wall 50" also helps to hold the magazine 14" in position within the housing 16".

The specific cross-sectional shape of the magazine may vary somewhat from the three preferred embodiments of the magazine 14, 14', 14" shown and described above. An important feature in this invention is the interaction between the housing 16, 16', 16" and the magazine 14, 14', 14" whereby the magazine 14, 14', 14" is removably held in position within the housing 16, 16', 16". In the preferred embodiments, tabs 32 projecting from the magazine end caps 30, 46 snap into tab slots 34, 34' in the housing 16, 16', 16". Also, a portion 66, 66', 66" of the housing interacts with a placement tang 68, 68', 68" on the magazine to help hold the magazine in position within the housing. Although the referenced portion 66, 66', 66" of the housing projects from the front wall 50, 50', 50" of the housing in each of the preferred embodiments, it could also project from any other wall of the housing without departing from the present invention.

Since the screw channels 76, 78 (FIG. 7A), 76', 76" (FIG. 7B), 76", 78" (FIG. 7C) integrally formed in the magazines 14 (FIG. 7A), 14' (FIG. 7B), 14" (FIG. 7C) of each of the preferred embodiments are similarly placed, a single type of magazine end cap (30 and 46 are interchangeable) may be used with each of the disclosed magazines 14, 14', and 14".

Comparing FIGS. 4A, 5A, 6A, 7A, and 8A to FIGS. 4B, 5B, 6B, 7B, and 8B, and to FIGS. 4C, 5C, 6C, 7C, and 8C, respectively, several common features of the three preferred embodiments of the present invention are apparent. Each of the housings 16, 16', 16" comprises a front wall 50, 50', 50", a bottom wall 54, 54', 54", and a rear wall 52, 52', 52". Further, a portion 66, 66', 66" of the front wall in each embodiment of the housing extends into the interior of the headrail 10 so that it may interact with a placement tang 68, 68', 68" comprising part of the magazine 14, 14', 14" in each embodiment. As shown in FIGS. 8A, 8B, and 8C, the housing includes a pair of tab slots 34, 34' and a battery-shaped opening 55, 55', 55". The tab slots 34, 34' receive the tabs 32 integrally formed along the lower edge of the magazine end caps 32, 46 (see, e.g., FIG. 11), and battery-shaped opening 55, 55', 55" is used for battery insertion into and extraction from the magazine 14, 14', 14".

The elongated openings 86, which are formed in the bottom wall 54, 54', 54" of the housing 16, 16', 16" in each of the three preferred embodiments, are positioned approximately below all but one of the batteries 18 and are useful for several purposes. For example, heat may be dissipated through these elongated openings 86 if the temperature within the headrail 10 increases during operation. Further, since it is possible to view the outside surface of the bottom wall 54, 54', 54" of the housing 16, 16', 16" when the adjustable window covering 12 is mounted for operation, these elongated openings 86 permit a quick check that the required batteries 18 are in position within the headrail 10 since a portion of each battery 18 will be visible through an elongated opening 86. Finally, the elongated openings 86 facilitate battery extraction as described next.

Figure 12:
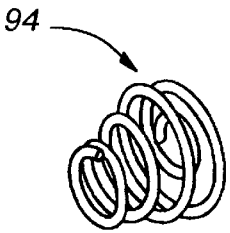
FIG. 12 is an enlarged view of the spring depicted in FIG. 11 that helps to ensure positive electrical contact.

The battery-shaped opening 55, 55', 55" in the bottom wall 54, 54', 54" of the housing 16, 16', 16" for each of the preferred embodiments permits one or more batteries 18 to be inserted into or extracted from the chamber formed between the battery magazine 14, 14', 14" and the bottom wall 54, 54', 54". In the preferred embodiments, the battery-shaped opening 55, 55', 55" is slightly wider than the diameter of a AA battery 18 and slightly shorter than a AA battery 18 so that the batteries can be inserted into the battery magazine through the battery-shaped opening at an angle and can then be pushed lengthwise into the magazine 14, 14', 14". Since the battery-shaped opening 55, 55', 55" is shorter than a battery 18, and since the spring 94 (FIGS. 9, 11, and 12) exerts a longitudinal force on the batteries 18, the endmost battery 18 will not fall out of the battery-shaped opening 55, 55', 55" accidentally. When it is time to extract the batteries from the battery magazine 14, 14', 14", a person may use a thin screwdriver to extract the first battery 18 from the battery magazine 14, 14', 14" through the battery-shaped opening 55, 55', 55". Then, the person can insert the screwdriver into the respective elongated openings 86 to push the batteries toward the battery-shaped opening 55, 55', 55", where they may be readily removed.

Figure 9:
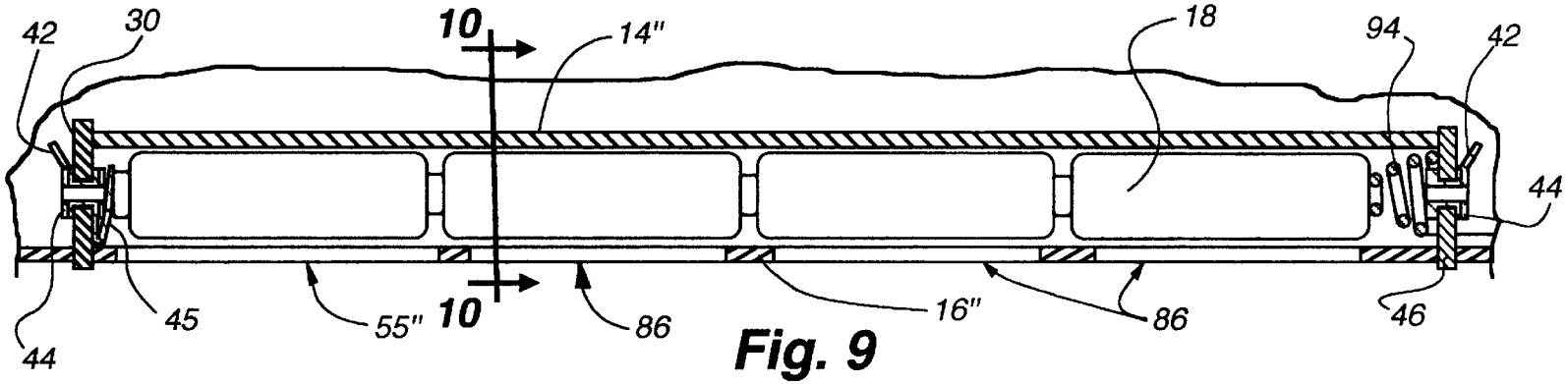
FIG. 9 is a fragmentary cross-sectional view along line 9—9 of FIG. 4C, depicting the batteries in place in a fully installed battery magazine according to the third preferred embodiment of FIGS. 7C and 10.
Figure 10:
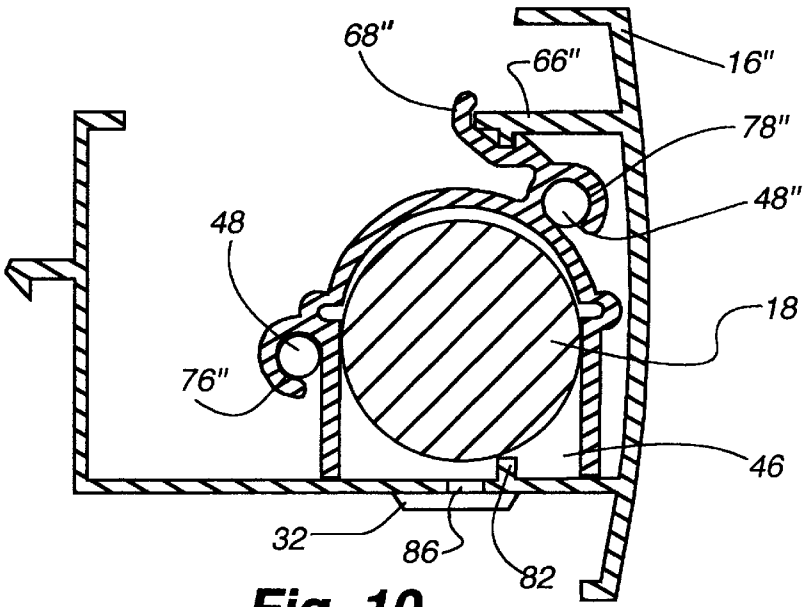
FIG. 10 is a cross-sectional view of the headrail along line 10—10 of FIG. 9, depicting the battery magazine and housing of the third preferred embodiment securing batteries in position within the headrail.

FIG. 9 is a partial cross-sectional view along line 9—9 of FIG. 4C, and depicts four batteries 18 in position in the magazine 14". Both magazine end caps 30, 46 are in place and the magazine 14" is not only fully assembled, but also clipped into position in the housing 16" of the headrail 10. Also clearly visible in FIG. 9 is a flexible contact strip 45, which is connected to the interior surface of the first magazine end cap 30 by the fastener 44. Thus, the fastener 44 secures both the terminal 42 to the exterior surface of the first magazine end cap 30, and the contact strip 45 to the interior surface of the first magazine end cap 30 to form a conductive path from the batteries 18 to the terminal 42. FIG. 10 is a cross-sectional view along line 10—10 of FIG. 9. Clearly visible in FIG. 10 is a battery 18 being held in position by the magazine 14". Visible in both FIGS. 9 and 10 are the elongated openings 86 positioned approximately below each battery 18 in the magazine 14". Visible in FIG. 9 is the battery-shaped opening 55".

Figure 11:
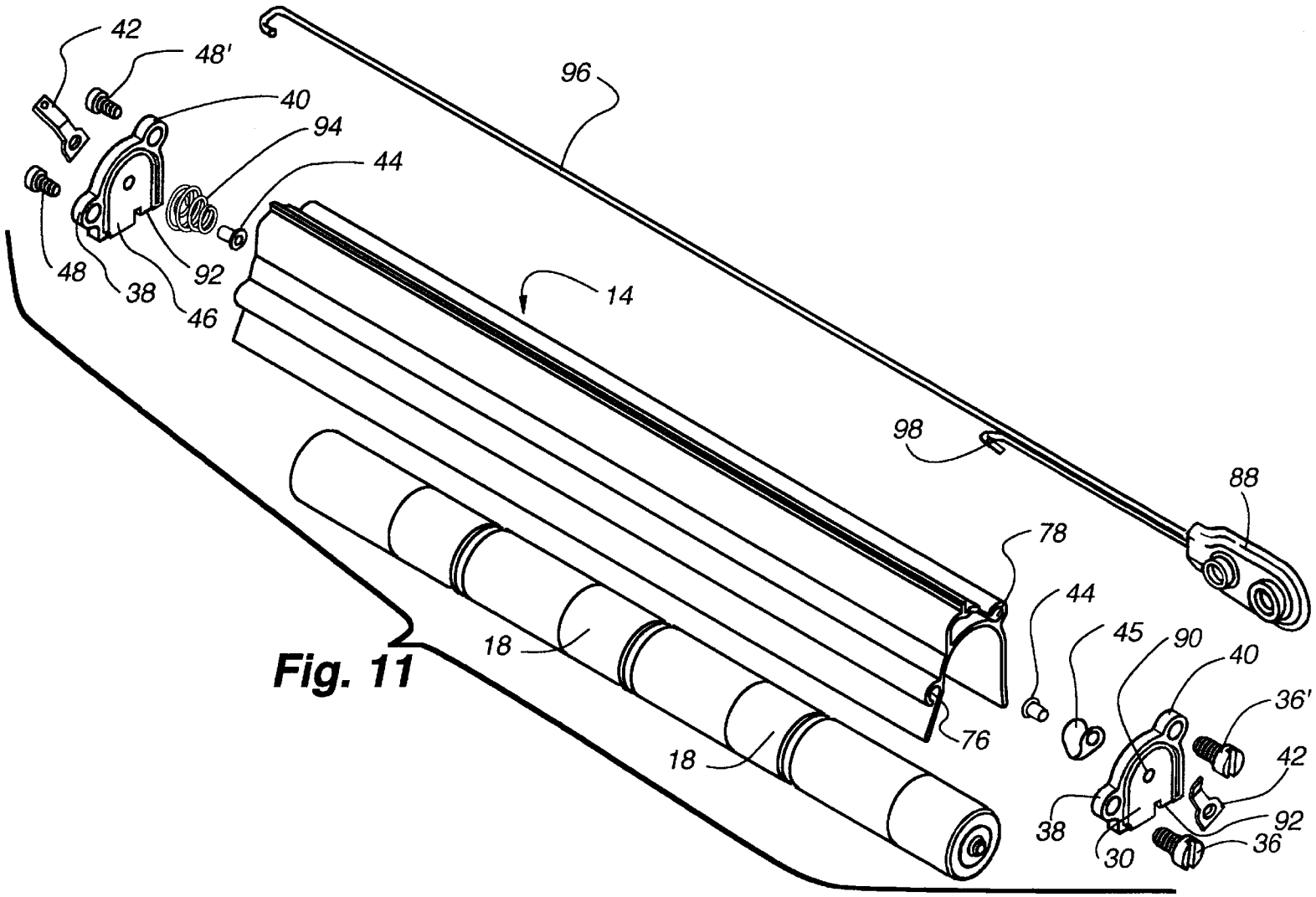
FIG. 11 is an exploded isometric view of the first preferred embodiment of the battery magazine and various components used by all of the embodiments to facilitate transfer of electrical energy from the batteries to a connector.

Referring now to FIG. 11, assembly of the battery magazine 14 with the various components that facilitate transfer of electrical energy from the batteries 18 to a connector 88 are next described. In FIG. 1, the magazine 14 according to the first embodiment is shown for demonstrative purposes. This embodiment of the magazine 14 is also shown in, for example, FIGS. 4A, 5A, and 7A. In the preferred embodiment, the magazine 14 is formed from a single piece of material. The length of the magazine 14 is easily adjusted by cutting an appropriate section of magazine material to accommodate a desired number of batteries 18. To assemble the magazine 14, the selected length of magazine material is first cut—in the example shown in FIG. 11, the magazine length selected accommodates four batteries 18. Once the desired length of magazine 14 material has been obtained, the remaining components that facilitate transfer of electrical energy from the batteries 18 to the connector 88 are assembled.

FIG. 11 is the back side (once installed in the headrail depicted in, for example, FIG. 1) of the magazine 14 according to the first preferred embodiment. Referring first to the right-hand portion of FIG. 11, assembly of the various components attached to the magazine 14 are described. The fastener 44 (e.g., a rivet) is used to attach both the conductive terminal 42 and the flexible contact strip 45 to the first magazine end cap 30, which has a hole 90 therethrough for that purpose. Once the terminal 42 and the flexible contact strip 45 have been fastened to the first magazine end cap 30, the first magazine end cap 30 may be attached to the magazine 14. As clearly shown in FIG. 11, in this preferred embodiment, the first magazine end cap 30 includes an alignment ridge 92 on each of its interior and exterior surfaces. There is an alignment ridge 92 on each side of the magazine end caps 30, 46 so that one design for the magazine end caps 30, 46 will work at either end of the magazine 14. Thus, in the preferred embodiments, the first and second magazine end caps 30, 46 are interchangeable, and the same magazine end cap may be used in each of the preferred embodiments. The alignment ridge 92 fits along the inner surface of the magazine 14. Once the alignment ridge 92 is thus placed along the inner surface of the magazine 14, the first and second attachment ears 38, 40, respectively, comprising part of the first magazine end cap 30 are properly positioned over the two screw channels 76, 78 integrally formed into the magazine 14. The attachment screws 36, 36' pass through the attachment ears 38, 40 of the magazine end cap 30 and are threaded into the screw channels 76, 78 of the magazine 14. The flexible contact strip 45 and the fastener 44 conduct electricity to the terminal 42, where it may be further conducted via the connector 88 to a device requiring electrical power.

An alternative type of magazine end cap is disclosed in the above-noted related U.S. utility application Ser. No. 09/480,913, filed Jan. 11, 2000. In that application, the magazine end caps do not include attachment ears 38, 40, and they do not have alignment ridges 92. Rather, the magazine end caps described in this related application just have holes through them to accommodate the attachment screws, and, rather than alignment ridges, the magazine end caps have a plurality of alignment pins on each side. These alternative magazine end caps would work for purposes of the present invention.

Referring now to the left-hand end of FIG. 11, which is the right-hand end of the magazine 14 as installed in the headrail 10 depicted in FIG. 1, assembly of the components attached to this end of the magazine are described next. A fastener 44 (e.g., a rivet) is used to attach a spring 94 to an interior surface of the second magazine end cap 46 while simultaneously connecting a second terminal 42 to the exterior surface of the second magazine end cap 46. This spring 94, which is enlarged in FIG. 12, will make electrical contact with the batteries 18 positioned by the magazine 14 and will thereby conduct electricity through the fastener 44 to the terminal 42 on the exterior surface of the second magazine end cap 46.

Once the spring 94 and terminal 42 have been thus attached to the second magazine end cap 46 with an appropriate fastener 44, the second magazine end cap 46 is ready for attachment to the magazine 14. As was the case with the opposite end of the magazine 14, one of the alignment ridges 92 (there is one on each side of the second magazine end cap 46 as there were on each side of the first magazine end cap 30) is aligned with the inner surface of the magazine 14 to appropriately position the magazine end cap 46 relative to the magazine 14. Once the second magazine end cap 46 is appropriately positioned, the first attachment ear 38 and the second attachment ear 40 are aligned with appropriate screw channels 76, 78, respectively, comprising part of the magazine 14. Once thus positioned, screws 48, 48' are inserted through the attachment ears 38, 40 and threaded into the screw channels 76, 78 to secure the second magazine end cap 46 to the magazine 14. Next, the batteries 18 are optionally placed into the magazine 14, and the fully-assembled magazine 14 is then inserted into the housing 16 as shown, for example, in FIG. 4A. Although it would make it less convenient to replace expired batteries, it is possible to form the housing 16 without the battery-shaped opening 55 if desired. Without the battery-shaped opening 55, it would be necessary to place the batteries 18 in the magazine 14 before inserting it into the housing 16, since the batteries 16 could not otherwise be inserted into the magazine 14. The magazine 14 is held in position within the housing 16 as described above. Then, the electrical connector 88 depicted in FIG. 11 would be connected to the terminals 42 (one on each end of the magazine 14) in a known manner. Additionally, any type of connector that is appropriate for the device that needs electricity could be attached to the negative lead 96 and positive lead 98 of the connector 88.

FIG. 13 depicts an exploded view similar to the right-hand portion of FIG. 11, but the magazine 14' shown in FIG. 13 is the magazine according to the second preferred embodiment of the present invention. The components depicted in FIG. 13 are assembled similar to the assembly steps described above, resulting in the fully assembled device depicted in FIG. 14.

Figure 15:
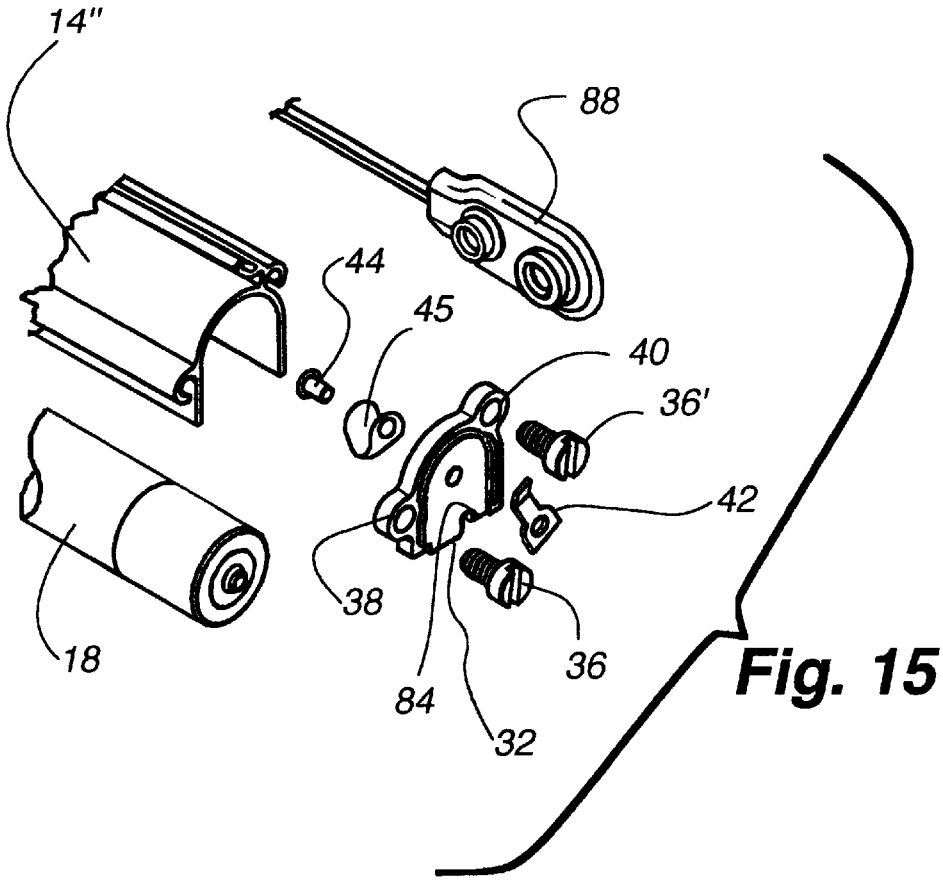
FIG. 15 is an exploded fragmentary isometric view similar to FIG. 13, but depicting the battery magazine of the third preferred embodiment.
Figure 16:
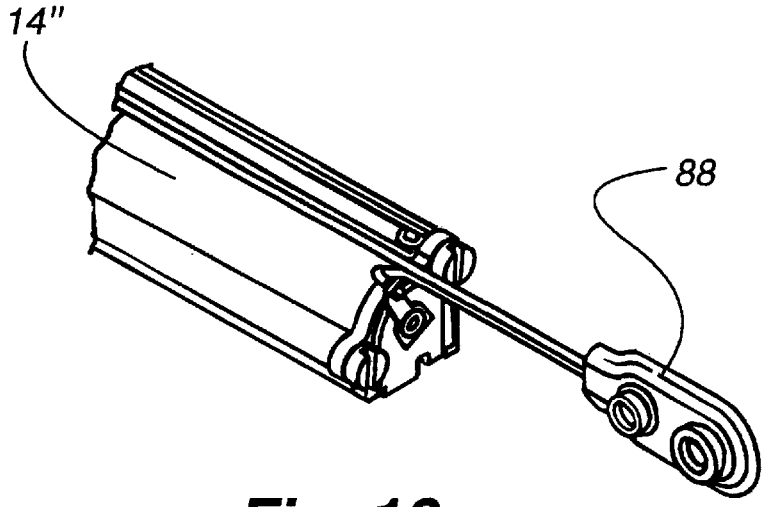
FIG. 16 is a fragmentary isometric view similar to FIG. 14, but depicting the battery magazine of the third preferred embodiment.

FIGS. 15 and 16 are similar to FIGS. 13 and 14, respectively, but depict the magazine 14" according to the third preferred embodiment of the present invention.

Although three preferred embodiments of this invention have been described above, those skilled in the art could make numerous alterations to the disclosed embodiments without departing from the spirit or scope of this invention. For example, the design of the front wall 50, 50', 50" of the housing 16, 16', 16", respectively, may take on one of many different shapes depending in part upon the taste of the purchaser. A different front wall is shown in each of FIGS. 2, 4A, 4B, and 4C, for example. Also, the battery magazine 14, 14', 14" may be cut any length to accommodate the required number of batteries 18 for energizing the motor that selectively configures the adjustable covering 12. When two or more batteries are mounted in the battery magazine of the present invention, they are connected in series. Thus, myriad housing shapes and battery magazine shapes and lengths are within the scope of the present invention. All directional references (e.g., upper, lower, upward, downward, left, right, leftward, rightward, top, bottom, above, below, vertical, horizontal, clockwise, and counterclockwise) above are only used for identification purposes to aid the reader's understanding of the present invention, and do not create limitations, particularly as to the position, orientation, or use of the invention. It is intended that all matter contained in the above description or shown in the accompanying drawings shall be interpreted as illustrative and not limiting.

We claim:

1. A powered covering for an architectural opening, conprising a headrail with a housing including an interior and an exterior;

a battery magazine attached wholly within said interior of said housing so as not to form part of said exterior of said housing, wherein said battery magazine includes a first end and a second end;

a first magazine end cap at said first end of said battery magazine; and a second magazine end cap at said second end of said battery magazine.

2. The powered covering of claim 1, further comprising a battery-powered actuator mounted within said housing.

3. A powered covering for an architectural opening, comprising a headrail with a housing having an interior, an exterior, a bottom wall, a first tab slot, a second tab slot, and a battery-insertion opening through said bottom wall;

a battery magazine removably snapped into said interior of said housing so as not to form part of said housing exterior, wherein said batten magazine includes a first end and a second end;

a first magazine end cap affixed to said first end of said battery magazine, said first magazine end cap having a bottom edge with a first tab extending therefrom, said first tab being inserted into said first tab slot of said housing;

a second magazine end cap affixed to said second end of said battery magazine, said second magazine end cap having a bottom edge with a second tab extending therefrom, said second tab being inserted into said second tab slot of said housing; and a battery-powered actuator mounted within said housing.

4. A headrail for a powered covering for an architectural opening, comprising a housing including an interior, an exterior, and a first tab slot extending through said housing from said interior to said exterior;

a battery magazine attached within said interior of said housing so as not to form part of said housing exterior, wherein said battery magazine includes a first end and a second end; and a first magazine end cap affixed to said first end of said battery magazine, said first magazine end cap having a bottom edge with a first tab extending therefrom, said first tab being inserted into said first tab slot of said housing to removably attach said battery magazine within said interior of said housing.

5. The headrail of claim 4, wherein said housing further includes a second tab slot extending through said housing from said interior to said exterior, said headrail further comprising a second magazine end cap affixed to said second end of said battery magazine, said second magazine end cap having a bottom edge with a second tab extending therefrom, said second tab being inserted into said second tab slot of said housing.

6. The headrail of claim 5, wherein said first and second magazine end caps each has an interior surface and an exterior surface, and wherein said headrail further comprises a first conductive terminal attached to said exterior surface of said first magazine end cap by a first fastener;

a second conductive terminal attached to said exterior surface of said second magazine end cap by a second fastener;

a spring attached to said interior surface of said second magazine end cap by said second fastener;

a battery-powered actuator mounted within said housing; and an electrical connector connecting said first and second conductive terminals to said actuator.

7. The headrail of claim 6, wherein said first and second fasteners are rivets.

8. The headrail of claim 6, wherein each of said first and second magazine end caps further includes an alignment ridge on each of its said interior and exterior surfaces.

9. The headrail of claim 5, wherein said battery magazine further includes a front leg and a rear leg.

10. A headrail for a powered covering for an architectural opening, comprising a housing including an interior and a first tab slot;

a battery magazine attached within said interior of said housing, wherein said battery magazine includes a first end and a second end;

a first magazine end cap affixed to said first end of said battery magazine, said first magazine end cap having a bottom edge with a first tab extending therefrom, said first tab being inserted into said first tab slot of said housing to removably attach said battery magazine within said interior of said housing;

wherein said housing further includes a second tab slot, said headrail further comprising a second magazine end cap affixed to said second end of said battery magazine, said second magazine end cap having a bottom edge with a second tab extending therefrom, said second tab being inserted into said second tab slot of said housing; and wherein said first magazine end cap is interchangeable with said second magazine end cap.

11. A headrail for a powered covering for an architectural opening, comprising a housing including an interior and a first tab slot;

a battery magazine attached within said interior of said housing, wherein said battery magazine includes a first end and a second end;

a first magazine end cap affixed to said first end of said battery magazine, said first magazine end cap having a bottom edge with a first tab extending therefrom, said first tab being inserted into said first tab slot of said housing to removably attach said battery magazine within said interior of said housing;

wherein said housing further includes a second tab slot, said headrail further comprising a second magazine end cap affixed to said second end of said battery magazine, said second magazine end cap having a bottom edge with a second tab extending therefrom, said second tab being inserted into said second tab slot of said housing;

wherein said first and second magazine end caps each has an interior surface and an exterior surface, and wherein said headrail further comprises a first conductive terminal attached to said exterior surface of said first magazine end cap by a first fastener;

a second conductive terminal attached to said exterior surface of said second magazine end cap by a second fastener;

a spring attached to said interior surface of said second magazine end cap by said second fastener;

a battery-powered actuator mounted within said housing; and an electrical connector connecting said first and second conductive terminals to said actuator; and wherein each of said first and second magazine end caps further includes at least one alignment pin on each of its said interior and exterior surfaces.

12. A headrail for a powered covering for an architectural opening, comprising a housing including an interior and a first tab slot;

a battery magazine attached within said interior of said housing, wherein said battery magazine includes a first end and a second end;

a first magazine end cap affixed to said first end of said battery magazine, said first magazine end cap having a bottom edge with a first tab extending therefrom, said first tab being inserted into said first tab slot of said housing to removably attach said battery magazine within said interior of said housing;

wherein said housing further includes a second tab slot, said headrail further comprising a second magazine end cap affixed to said second end of said battery magazine, said second magazine end cap having a bottom edge with a second tab extending therefrom, said second tab being inserted into said second tab slot of said housing;

wherein said battery magazine further includes a front leg and a rear leg; and wherein said battery magazine further includes a first screw channel that is integrally formed as part of said rear leg of said magazine, and a second screw channel that is integrally formed as part of said front leg of said magazine.

13. The headrail of claim 12, wherein said housing includes a substantially flat bottom wall, and wherein said battery magazine further includes an exterior surface and a placement tang extending substantially vertically upward from said exterior surface near said front leg.

14. A headrail for a powered covering for an architectural opening, comprising a housing including an interior and a first tab slot;

a battery magazine attached within said interior of said housing, wherein said battery magazine includes a first end and a second end;

a first magazine end cap affixed to said first end of said battery magazine, said first magazine end cap having a bottom edge with a first tab extending therefrom, said first tab being inserted into said first tab slot of said housing to removably attach said battery magazine within said interior of said housing;

wherein said housing further includes a second tab slot, said headrail further comprising a second magazine end cap affixed to said second end of said battery magazine, said second magazine end cap having a bottom edge with a second tab extending therefrom, said second tab being inserted into said second tab slot of said housing;

wherein said battery magazine further includes a front leg and a rear leg;

wherein said housing includes a bottom wall, and wherein said bottom wall includes a first channel and a second channel.

15. The headrail of claim 14, wherein said first channel receives said front leg of said battery magazine, and said second channel receives said rear leg of said battery magazine when said magazine is in position in said housing.

16. A headrail for a powered covering for an architectural opening, comprising a housing including an interior and a first tab slot;

a battery magazine attached within said interior of said housing, wherein said battery magazine includes a first end and a second end;

a first magazine end cap affixed to said first end of said battery magazine, said first magazine end cap having a bottom edge with a first tab extending therefrom, said first tab being inserted into said first tab slot of said housing to removably attach said battery magazine within said interior of said housing;

wherein said housing further includes a second tab slot, said headrail further comprising a second magazine end cap affixed to said second end of said battery magazine, said second magazine end cap having a bottom edge with a second tab extending therefrom, said second tab being inserted into said second tab slot of said housing;

wherein said battery magazine further includes a front leg and a rear leg; and wherein said housing includes a bottom wall having a battery-shaped opening therein, a front wall, a rear wall, and a portion extending into said interior of said housing from one of said front wall and said rear wall, and wherein said battery magazine further includes a placement tang that interacts with said portion, thereby helping to hold said battery magazine in position within said housing.

17. The headrail of claim 16, wherein said portion extends rearwardly from said front wall, and wherein said portion includes a free end that exerts a downward force on said placement tang.

18. The headrail of claim 16, wherein said placement tang has a distal end with a channel therein, and wherein said portion of said housing engages said channel.

19. The headrail of claim 18, wherein said distal end of said placement tang includes a sloped surface that guides said portion of said housing into said channel.

20. The headrail of claim 16, wherein said front wall is substantially a mirror image of said rear wall.

21. The headrail of claim 16, wherein said front wall is arcuate.

22. The headrail of claim 21, wherein said housing further includes a bottom wall having a longitudinally extending rib integrally formed as part thereof, and wherein said magazine end caps each further includes a notch along said bottom edges, wherein said notches ride on said rib.

23. A headrail for a powered covering for an architectural opening, comprising a housing having a first tab slot, a second tab slot, and a battery-insertion opening;

a battery magazine removably snapped into said housing, wherein said battery magazine includes a first end and a second end;

a first magazine end cap affixed to said first end of said battery magazine, said first magazine end cap having a bottom edge with a first tab extending therefrom, said first tab being inserted into said first tab slot of said housing;

a second magazine end cap affixed to said second end of said battery magazine, said second magazine end cap having a bottom edge with a second tab extending therefrom, said second tab being inserted into said second tab slot of said housing;

a battery-powered actuator mounted within said housing; and wherein said first magazine end cap is interchangeable with said second magazine end cap, and wherein said magazine end caps further include a first attachment ear and a second attachment ear.

24. The headrail of claim 23, wherein said battery magazine has a longitudinal axis, and wherein said battery magazine further includes first and second screw channels, each of said screw channels having a longitudinal axis that is oriented substantially parallel to said longitudinal axis of said battery magazine.

25. The headrail of claim 24, wherein each of said magazine end caps is affixed to said respective ends of said battery magazine with two screws, one passing through each of said first and second attachment ears and being screwed into one of said first and second screw channels.

26. The headrail of claim 25, wherein said first and second attachment ears are integrally formed as part of said magazine end caps.

27. The headrail of claim 26, wherein said first and second screw channels are integrally formed as part of said battery magazine.

28. The headrail of claim 27, wherein said bottom wall of said housing further includes a plurality of elongated openings.

* * * * *

UNITED STATES PATENT AND TRADEMARK OFFICE

CERTIFICATE OF CORRECTION

PATENT NO. : 6,516,858 B1
DATED : February 11, 2003
INVENTOR(S) : Richard N. Anderson et al.

It is certified that error appears in the above-identified patent and that said Letters Patent is hereby corrected as shown below:

Title page,
Insert the following items:
-- [73] Assignee: Hunter Douglas Inc., Upper Saddle River, NJ (US) --; and
[74] *Attorney, Agent, or Firm* - Dorsey & Whitney LLP --.

Signed and Sealed this

Twenty-third Day of March, 2004

JON W. DUDAS
*Acting Director of the United States Patent and Trademark Office*